US007797806B2

(12) United States Patent
Schwarz et al.

(10) Patent No.: US 7,797,806 B2
(45) Date of Patent: Sep. 21, 2010

(54) INTERNAL HIGH-PRESSURE SHAPING METHOD FOR SHAPING CONICAL TUBES MADE OF METAL

(75) Inventors: Stefan Schwarz, Lünen (DE); Sven Schneider, Boxberg-Windischbuch (DE); Matthias Aust, Slanheim (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 1010 days.

(21) Appl. No.: 10/568,265

(22) PCT Filed: Aug. 4, 2004

(86) PCT No.: PCT/EP2004/008727

§ 371 (c)(1),
(2), (4) Date: Aug. 18, 2006

(87) PCT Pub. No.: WO2005/018846

PCT Pub. Date: Mar. 3, 2005

(65) Prior Publication Data

US 2007/0180677 A1 Aug. 9, 2007

(30) Foreign Application Priority Data

Aug. 13, 2003 (DE) ..... 103 37 383

(51) Int. Cl.
*B23P 17/00* (2006.01)
*B21D 26/02* (2006.01)
*B21D 41/00* (2006.01)

(52) U.S. Cl. ..... 29/421.1; 72/54; 72/57; 72/60; 72/367.1; 72/370.1; 72/370.22

(58) Field of Classification Search ..... 29/421.1; 72/54, 57, 58, 60, 61, 62, 367.1, 370.04, 72/370.06, 370.1, 370.22
See application file for complete search history.

(56) References Cited

U.S. PATENT DOCUMENTS

| | | | | |
|---|---|---|---|---|
| 4,449,281 | A * | 5/1984 | Yoshida et al. | 29/421.1 |
| 4,590,655 | A * | 5/1986 | Javorik | 29/421.1 |
| 4,761,982 | A * | 8/1988 | Snyder | 72/58 |
| 5,022,135 | A * | 6/1991 | Miller et al. | 29/421.1 |
| 6,216,509 | B1 | 4/2001 | Lotspaih et al. | |

(Continued)

FOREIGN PATENT DOCUMENTS

DE 699 06 093 T2 9/2003

(Continued)

*Primary Examiner*—Jermie E Cozart
(74) *Attorney, Agent, or Firm*—Proskauer Rose LLP

(57) ABSTRACT

A method for shaping a conical metal tube using a tool that has sealing pistons and a die cavity with a complex contour is described. The die cavity has two ends with a cylindrical portion of the die cavity located at each end. The method includes inserting the conical tube into the die cavity such that the ends of the conical tube protrude into the cylindrical sections of the die cavity. Sealing pistons engage the tube ends and press each tube end against a cylindrical portion of the die cavity to seal an interior space of the conical tube. The tube is shaped by applying pressure to the sealed interior of the tube to force the tube against the complex contour of the die cavity while simultaneously axially compressed the tube by exerting axial forces on the tube ends with the sealing pistons.

2 Claims, 3 Drawing Sheets

U.S. PATENT DOCUMENTS

| | | | | |
|---|---|---|---|---|
| 6,820,317 | B2 * | 11/2004 | Okada | 29/421.1 |
| 6,845,552 | B2 * | 1/2005 | Blough | 29/421.1 |
| 7,284,403 | B2 * | 10/2007 | Wagner et al. | 72/62 |
| 2003/0126730 | A1 | 7/2003 | Barber et al. | |
| 2007/0209418 | A1 * | 9/2007 | Koelln et al. | 72/56 |

FOREIGN PATENT DOCUMENTS

| | | | |
|---|---|---|---|
| EP | 439764 | A2 * | 8/1991 |
| EP | 1 109 636 | B1 | 3/2003 |
| JP | 53001165 | | 7/1978 |
| WO | WO 2004/041458 | | 5/2004 |

* cited by examiner

INTERNAL HIGH-PRESSURE SHAPING METHOD FOR SHAPING CONICAL TUBES MADE OF METAL

BACKGROUND OF THE INVENTION

Internal high-pressure shaping method for shaping conical tubes made of metal. The invention relates to an internal high-pressure shaping method for shaping conical tubes made of metal, in particular steel, in a tool comprising a die cavity having a complex contour and two sealing pistons, by means of which the interior of the tube to be shaped is sealed at its two ends, in that the sealing pistons, which engage with the tube ends, press the tube ends against the wall of cylindrical portions at the two ends of the die cavity.

In the internal high-pressure shaping of tubes, relatively high degrees of shaping may be achieved if material is axially redisplaced during radial flaring of the tubes. In the case of cylindrical tubes, the axial redisplacement of material is unproblematic. In the case of conical tubes, on the other hand, the redisplacement is not easily possible for geometrical reasons, because there are sealing problems at the conical tube ends. In order nevertheless to allow even conical tubes to undergo internal high-pressure shaping with the axial redisplacement of material, tubes are used in which short cylindrical portions are connected to the conical part. The tool accordingly comprises correspondingly cylindrical portions on both open sides of the die cavity, so the cylindrical portions of the tool, is inserted into the tool, in that these conical ends of the tube are pressed by the sealing pistons to be introduced until they abut the cylindrical portions of the tool, optionally with redial flaring, and in that the internal high-pressure shaping process then takes place by means of at least one sealing piston acting on the end face of the associated tube end, wherein during the compression process at least on of the cylindrically flared tube ends is displaced up to the end of the associated cylindrical portion.

The object of the invention is to provide an internal high-pressure shaping method for shaping conical tubes, which allows high degrees of shaping of complex shapes and necessitates lower costs than the described method.

SUMMARY OF THE INVENTION

In the case of a method of the type mentioned at the outset, this object is achieved in that a tube, which is conical over its entire length and the ends of which protrude into the region of the cylindrical portions of the tool, is inserted into the tool, in that these conical ends of the tube are pressed by the sealing pistons to be introduced until they abut the cylindrical portions of the tool, optionally with radial flaring, and in that the internal high-pressure shaping process then takes place by means of internal pressure built up in the interior thus sealed of the tube, with simultaneous axial compression of the tube by means of at least one sealing piston acting on the end face of the associated tube end, wherein during the compression process at least on of the cylindrically flared tube ends is displaced up to the end of the associated cylindrical portion.

In the case of the method according to the invention, the purely conical tube that is to undergo internal high-pressure shaping is introduced into a tool of conventional configuration, wherein the unique feature consists in the fact that the conical tube ends protrude into the cylindrical end portions of the tool Prior to the internal high-pressure shaping process itself, the conical ends are pressed by means of the sealing pistons to be introduced, in particular with radial flaring of the smaller conical end, against the cylindrical end portions in order to achieve the degree of tightness, at the tube ends with respect to the introduced sealing pistons, required for the internal high-pressure shaping process. Axial redisplacement, even up to the end of the cylindrical end portions of the tool, is nevertheless possible. An extremely flared hollow profile member of complex shape, which may be conical up to its edges, may therefore be obtained.

DETAILED DESCRIPTION OF THE INVENTION

The invention will be described below in greater detail with reference to the drawings, in which.

Figure 1:
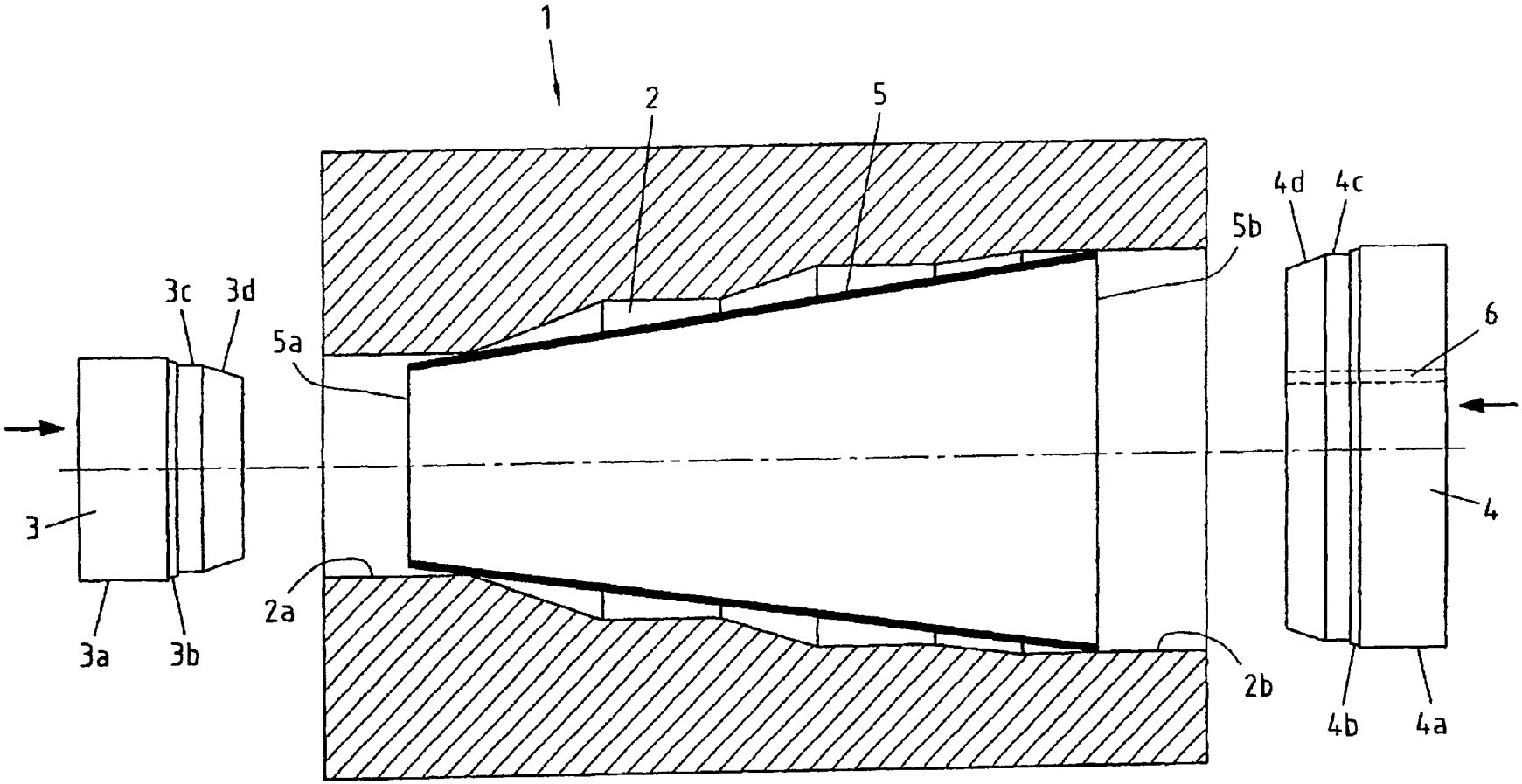
FIG. 1 is a side view and schematic cross section of a conical tube inserted into a tool, with two sealing pistons to be introduced.

The tool 1 comprises a die cavity 2, which is complex in shape and is composed, in the embodiment, of conical and cylindrical portions. The die cavity 2 comprises at its two open ends cylindrical portions 2*a*, 2*b*. The dimensions of two sealing pistons 3, 4 are adapted to these cylindrical portions 2*a*, 2*b*. Each sealing piston 3, 4 is divided into four portions. The portion 3*a*, 4*a* having the largest diameter corresponds to the internal diameter of the cylindrical portions 2*a*, 2*b* of the workpiece 1. The portion 3*b*, 4*b*, which is comparatively very short in the axial direction and is connected to said portion 3*a*, 4*a* having the largest diameter, is conical. A slightly longer cylindrical portion 3*c*, 4*c*, the external diameter of which is slightly smaller (=double wall thickness of the tube) than the internal diameter of the portions 2*a*, 2*b*, is connected to said conical portion 3*b*, 4*b*. Finally, a larger conical portion 3*d*, 4*d*, which acts as a mandrel for radially flaring or for centring the associated tube end, is connected to said cylindrical portion 3*c*, 4*c*.

A tube 5, which is conical over its entire length and both ends 5*a*, 5*b* of which are located within the conical portions 2*a*, 2*b* of the tool 1, is inserted into the tool 1.

Figure 2:
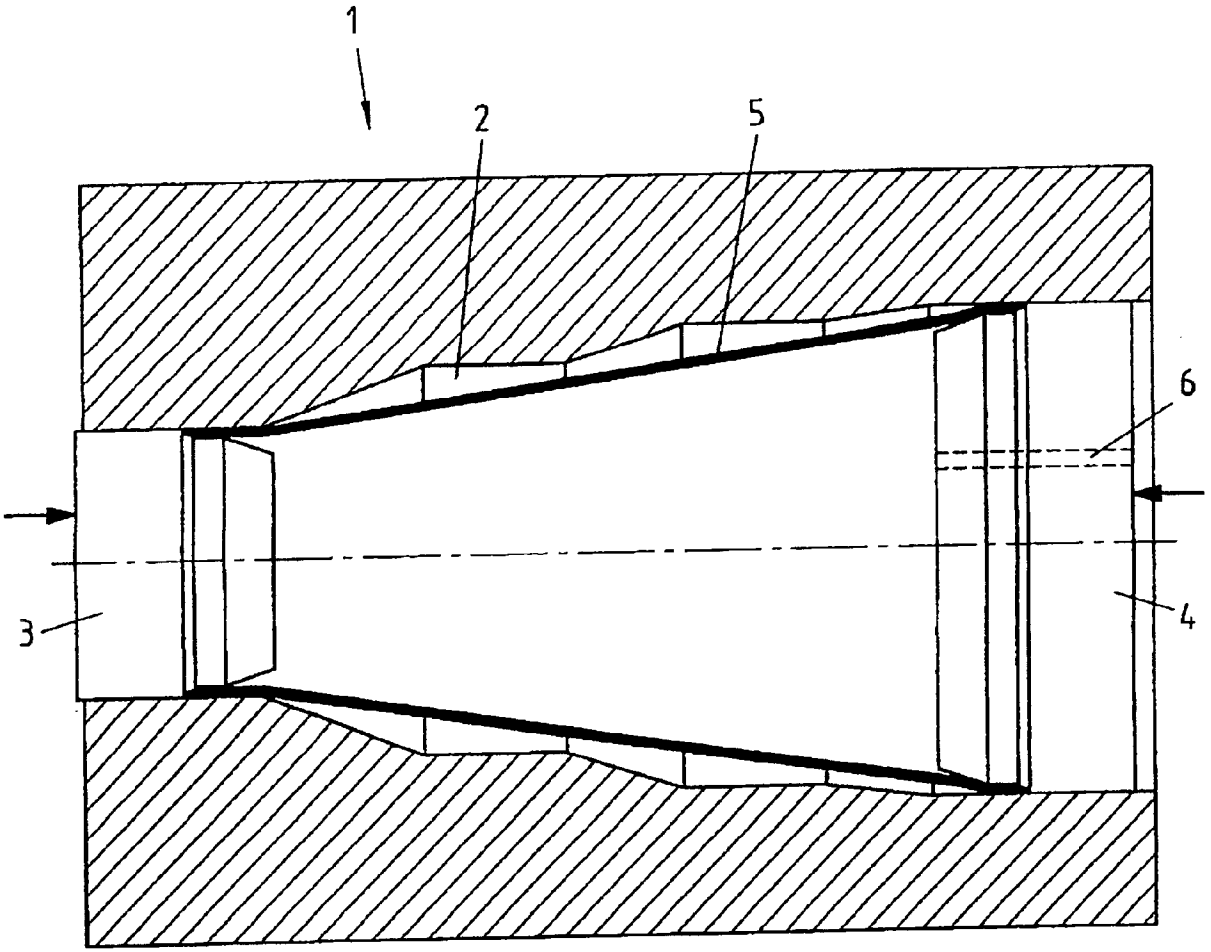
FIG. 2 shows the cylindrical tube in the tool with sealing pistons introduced into the tube ends, immediately prior to the internal high-pressure shaping process.

If the two sealing pistons are moved from the position illustrated in FIG. 1 into the position illustrated in FIG. 2, the tube 5 is then radially flared at least at its smaller end 5*a*. but preferably at both its ends 5*a*, 5*b*, by means of the conical portions 3*d*, 4*d* until its edges are located between the cylindrical portions 3*c*, 4*c* and the cylindrical portion 2*a*, 2*b* of the tool 1. The configuration is such that the tube ends are clamped. As a result of the axial pressure exerted by the sealing pistons 3, 4 onto the tube 5, the edges of said tube are placed against the short conical portions 3*b*, 4*b*, thus further improving the sealing effect. Alternatively, wedge-shaped grooves, clamping sealing pistons or the like may also be provided to improve the sealing effect. The tube 5 in the tool 1 is thus prepared for the internal high-pressure shaping process.

Figure 3:
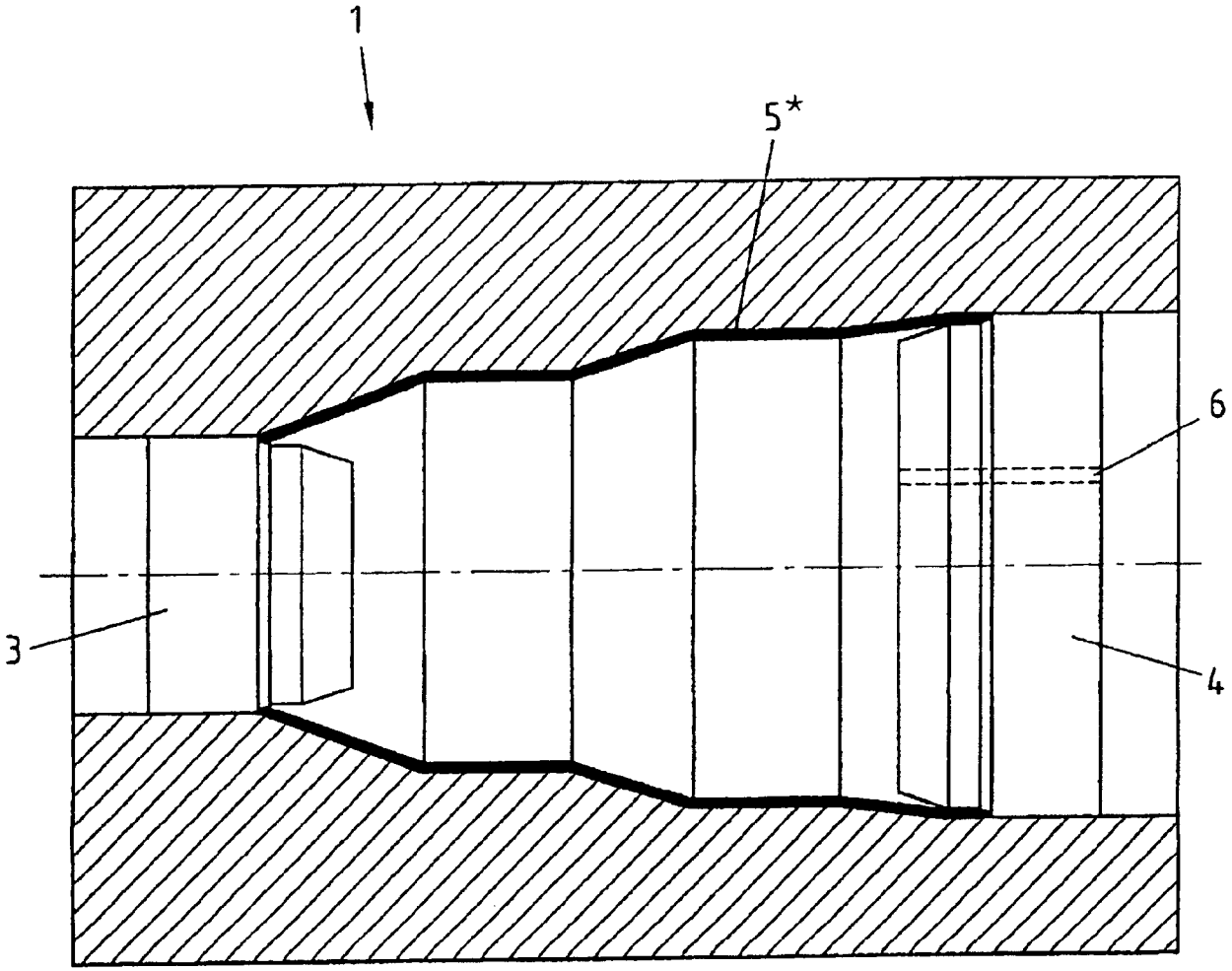
FIG. 3 shows the tube having undergone internal high-pressure shaping, at the end of the internal high-pressure shaping process.

As FIG. 3 illustrates, a pressure medium is then introduced in a manner known per se, for example via a channel 6 in the larger sealing piston 4, into the sealed interior 5*c* of the tube 5 and an internal high pressure is built up. This internal high pressure causes the tube 5 to flare. At the same time as the tube 5 is flared, it is also axially compressed by means of displacement of the two sealing pistons 3, 4. As a result of this axial compression, high degrees of flaring may be achieved without undesirable material thinning taking place. As FIG. 3 further illustrates, the axial displacement takes place up to the edge of the die cavity 2. A substantially deformed tube 5* having a complex structure is obtained as a result.

The invention claimed is:

1. A method of shaping a conical tube made of metal in a tool comprising a first sealing piston, a second sealing piston and a die cavity that has a complex contour including a first cylindrical portion at a first end of the die cavity and a second cylindrical portion at a second end of the die cavity, the method comprising:

inserting the conical tube having a conical shape along an entire length of the tube into the die cavity of the tool such that a first tube end protrudes into the first cylindrical portion of the die cavity and a second tube end protrudes into the second cylindrical portion of the die cavity;

engaging the first tube end with a first sealing piston and pressing the first tube end with the first sealing piston until the first tube end abuts the first cylindrical portion of the die cavity, and engaging the second tube end with a second sealing piston and pressing the second tube end with the second sealing piston until the second tube end abuts the second cylindrical portion of the die cavity, thereby sealing an interior of the conical tube; and applying pressure to the sealed interior of the conical tube and simultaneously axially compressing the conical tube by one or both of: exerting an axial force on an end face of the first tube end with the first sealing piston, and exerting an axial force on an end face of the second tube end with the second sealing piston;

wherein during the step of applying pressure to the interior space of the conical tube and simultaneously axially compressing the tube, the first tube end is displaced until the first tube end does not protrude into the first cylindrical portion of the cavity, or the second tube end is displaced until the second tube end does not protrude into the second cylindrical portion of the cavity.

2. The method of claim 1, wherein during the step of applying pressure to the interior space of the conical tube and simultaneously axially compressing the tube, both the first tube end is displaced until the first tube end does not protrude into the first cylindrical portion of the cavity and the second tube end is displaced until the second tube end does not protrude into the second cylindrical portion of the cavity.

* * * * *